US006843316B2

(12) United States Patent
Jackson et al.

(10) Patent No.: US 6,843,316 B2
(45) Date of Patent: Jan. 18, 2005

(54) METHOD FOR IMPROVING WELL QUALITY

(75) Inventors: Richard C. Jackson, Forth Worth, TX (US); Michael E. Judkins, Oconomowoc, WI (US)

(73) Assignee: AquaStream, Fort Worth, TX (US)

( * ) Notice: Subject to any disclaimer, the term of this patent is extended or adjusted under 35 U.S.C. 154(b) by 105 days.

(21) Appl. No.: 10/239,738

(22) PCT Filed: Mar. 29, 2001

(86) PCT No.: PCT/US01/10311

§ 371 (c)(1),
(2), (4) Date: Sep. 25, 2002

(87) PCT Pub. No.: WO01/73263

PCT Pub. Date: Oct. 4, 2001

(65) Prior Publication Data

US 2003/0056957 A1 Mar. 27, 2003

Related U.S. Application Data

(60) Provisional application No. 60/192,915, filed on Mar. 29, 2000.

(51) Int. Cl.[7] ..... E21B 43/02; E21B 43/14; E21B 47/10

(52) U.S. Cl. ..... 166/254.2; 166/106; 166/250.01; 166/254.1; 166/311; 166/313; 166/369; 166/378; 166/387; 73/152.02; 73/152.14

(58) Field of Search ..... 166/250.01, 254.1, 166/254.2, 264, 311, 313, 369, 378, 380, 387, 106, 228; 73/152.02, 152.14, 152.23, 152.29; 210/747

(56) References Cited

U.S. PATENT DOCUMENTS

| | | | | |
|---|---|---|---|---|
| 2,622,683 A | * | 12/1952 | Silitch et al. | 166/311 |
| 2,814,947 A | | 12/1957 | Stegemeier et al. | |
| 3,123,708 A | | 3/1964 | Limanek | |
| 3,757,813 A | | 9/1973 | Levenberg | |
| 4,014,387 A | * | 3/1977 | Fink | 166/369 |
| 4,474,409 A | | 10/1984 | Trevits et al. | |
| 4,624,319 A | | 11/1986 | Van Der Borght | |
| 4,745,975 A | | 5/1988 | Price | |
| 4,779,682 A | * | 10/1988 | Pelzer | 166/370 |
| 5,078,213 A | | 1/1992 | Canutt | |
| 5,190,108 A | * | 3/1993 | Mansuy | 166/371 |
| 5,447,201 A | | 9/1995 | Mohn | |
| 5,579,845 A | | 12/1996 | Jansen et al. | |
| 5,664,628 A | | 9/1997 | Koehler et al. | |

FOREIGN PATENT DOCUMENTS

| | | |
|---|---|---|
| EP | 0747142 A1 | 11/1996 |
| GB | 2343468 A | 5/2000 |
| GB | 2343691 A | 5/2000 |

* cited by examiner

*Primary Examiner*—George Suchfield
(74) *Attorney, Agent, or Firm*—Michael Best & Friedrich LLP

(57) ABSTRACT

A method of improving the quality of liquid coming from a well that has a pump and pipe assembly. The method includes identifying a region of the well that is low in contamination and a region of the well that is high in contamination, and modifying the pump and pipe assembly so that suction of the assembly is enhanced in the region that is low in contamination and inhibited in the region that is high in contamination. The method also includes cleaning the well in the region of low contamination. Modifying the pump and pipe assembly includes coupling a suction control device to the pump and pipe assembly, and positioning the suction control device in the region of low contamination, and forming a barrier between the region of low contamination and the region of high contamination by attaching a flow control disk to the pump and pipe assembly.

12 Claims, 4 Drawing Sheets

METHOD FOR IMPROVING WELL QUALITY

This application claims the benefit of Provisional application Ser. No. 60/192,915, filed Mar. 29, 2000.

FIELD OF THE INVENTION

The present invention generally relates to wells, such as water wells and oil wells, and specifically relates to methods for improving the quality of the liquid (e.g., water or oil) removed from wells.

BACKGROUND OF THE INVENTION

In 1976, the United States Environmental Protection Agency (EPA) promulgated interim drinking water standards under the Safe Drinking Water Act (SDWA). In 1991, the EPA proposed revisions to the 1976 requirements, and in 1996 the SDWA was amended. The amended SDWA established a list of contaminants to be regulated under primary standards and secondary standards. The primary standards are based on health effects and the secondary standards are based on aesthetics. The standards establish a maximum contaminant level for several contaminants.

One group of contaminants that is regulated under the SDWA is called radionuclides, including radium, gross alpha, and uranium. The primary standards for these three radionuclides are 5 pCi/L, 15 pCi/L and 30 pCi/L, respectively. Other contaminants that are generally undesirable include arsenic, iron, and others. It can be appreciated that it would be desirable to have a method for reducing the level of contaminants in water that is withdrawn from a water well.

Similar to water wells, oil coming from oil wells can be contaminated. For example, oil contaminants can include sand, paraffin, water, or minerals. While contamination of oil is not typically a health hazard, the value and usefulness of contaminated oil is typically significantly less than that of cleaner oil. Therefore, it can be appreciated that it would be desirable to have a method for reducing the level of contaminants in oil that is withdrawn from an oil well.

SUMMARY OF THE INVENTION

The present invention provides such a method of improving the quality of liquid drawn from a well. The invention is based on the recognition that liquid within a given well is actually a mixture of liquid from different sections (e.g., depths) within the well, and that the quality of the liquid can vary significantly between sections. For example, water coming from one section of a water well could have significantly higher levels of radionuclides than water coming from a different section of the well. Under normal operation of a well, the liquid pumped from the well is a mixture of liquid from various sections. In accordance with the present invention, the well bore is modified and the well equipment is specifically constructed so that more of the "cleaner" liquid is pumped from the well compared to the more "contaminated" water.

In order to increase the amount of cleaner liquid coming from the well, the method includes sampling the liquid from the well to determine which sections of the well produce the cleanest liquid. After the various sections of the well have been identified and labeled (e.g., according to their relative amount of contaminants), the well equipment is modified to enhance the amount of liquid being drawn from the cleaner sections of the well and to reduce the amount of liquid drawn from the more contaminated sections of the well. This can be accomplished using a suction flow control device. The suction flow control device includes suction elements that are vertically spaced within the well in order to distribute the suction from the pump along the vertical length of the well. The present invention positions the elements at or near the cleaner sections of the well. More specifically, the present invention utilizes a suction control device so that the suction created by the pump is enhanced in the sections of the well that produce cleaner liquid and is inhibited in the sections of the well that produce more contaminated liquid. By virtue of this design, the contamination level of the liquid being pumped from the well is reduced.

In order to decrease the amount of liquid flowing from one section of the well to another section of the well (e.g., from a more contaminated section to a less contaminated section), the pump equipment can be provided with flow control disks that extend radially from the suction flow control device (or other part of the pump and pipe assembly) and toward the inner surface of the well. These flow control disks provide a barrier between a more contaminated section and cleaner section, thereby reducing the amount of mixing of liquid from the two sections.

With specific regard to water wells, the present invention is also based on the theory that a large amount of the radionuclides found in water is caused by the contamination of the mineral cake found within the well. In a preferred embodiment of the invention, the mineral cake is at least partially removed from the wall of the well, resulting in lower contamination of the water and also a high flow rate of water. Then, the well equipment is modified (e.g., using suction control devices and flow control disks) to enhanced flow from the cleaner sections of the well.

It is also believed that practicing the present invention will reduce the rate at which the mineral cake re-forms on the walls of the bore. More specifically, the strategic use of a suction flow control device as described above will result in a wider distribution of energy throughout the well. This results in slower-moving water, and a corresponding decrease in pressure drop at the walls of the bore. It is theorized that the decreased pressure drop will result in less precipitation of minerals.

DETAILED DESCRIPTION OF THE PREFERRED EMBODIMENT

FIGS. 1–4 illustrate one embodiment of the present invention as used in connection with the treatment of a water well for purposes of reducing the level of radionuclides in water pump from the well. Of course, it should be understood that other contaminants could be removed using the same of similar process. The illustrated embodiment utilizes a two-phase process to reduce contamination of water pumped from a water well.

Phase I includes gathering data regarding historical well performance, sampling and logging the characteristics of water from different sections of the well, and cleaning the well. Data gathering involves collecting and reviewing historic data about the well. This data includes hydraulic, water chemistry, and geologic information. In the event that recent data is not available at different flow rates, this data can be collected prior to removing the pump. The primary purpose of this step in the process is to provide a base line against which future data can be compared in order to determine whether the process is successful.

Prior to proceeding with the sampling and logging portion of the process, the pumping equipment is removed, and a small submersible pump is inserted into the well. Logging of the well includes measuring the size of the well along the length of the well using a caliper log, measuring the flow rate of the well along the length of the well using a spinner log, and measuring the radiation of the well along the length of the well using a gamma log. The use of these logging techniques is well known in the water well field. In addition, down hole televising can be used to look for any irregularities in the well (e.g., fractures, plugging, etc.). Finally, water samples are collected from various sections of the well and at various flow rates in order to determine the quality of the water coming from each section.

Figure 1:
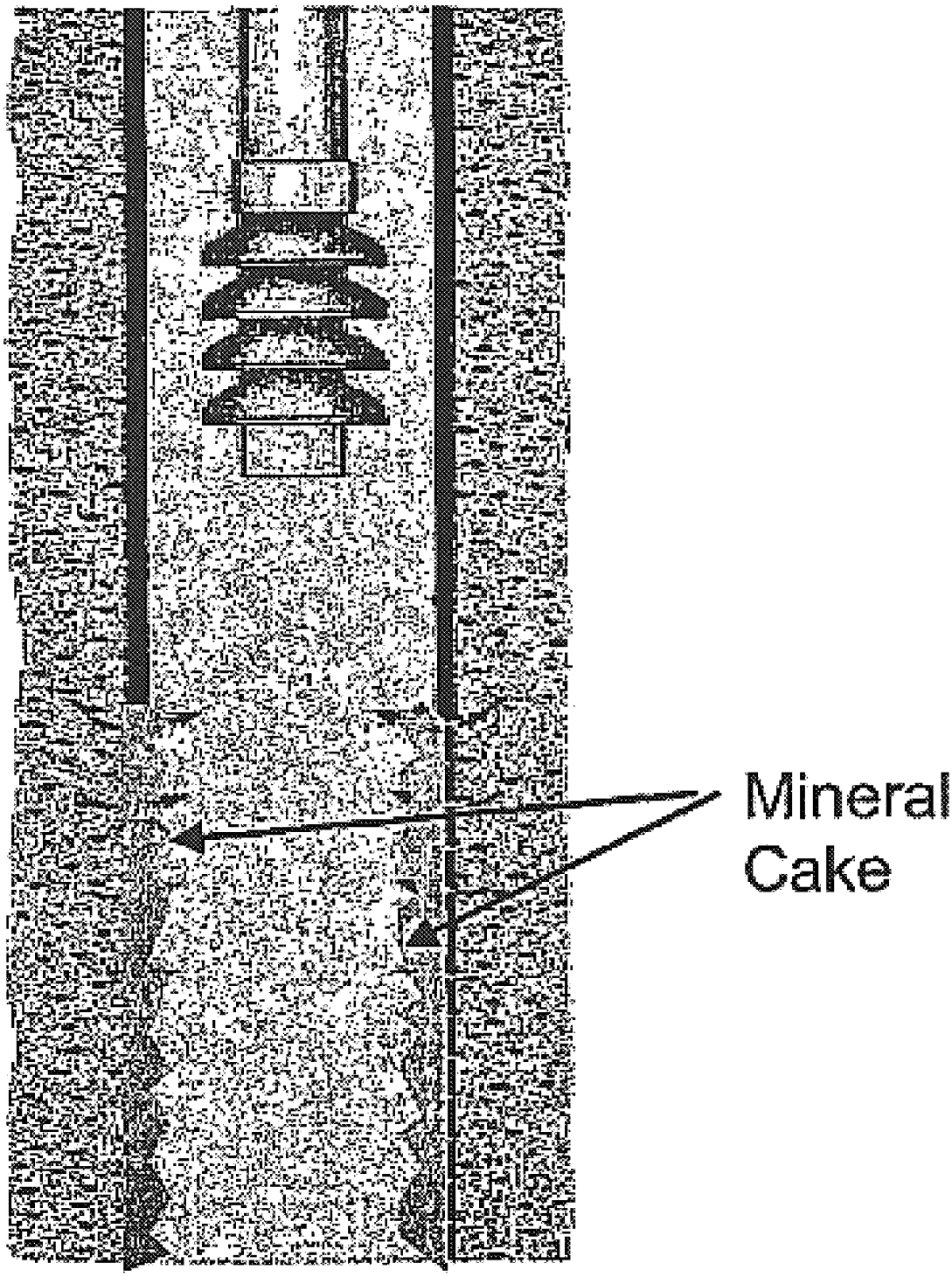
FIG. 1 illustrates a cross section of a water well prior to being treated according to the method of the present invention.
Figure 2:
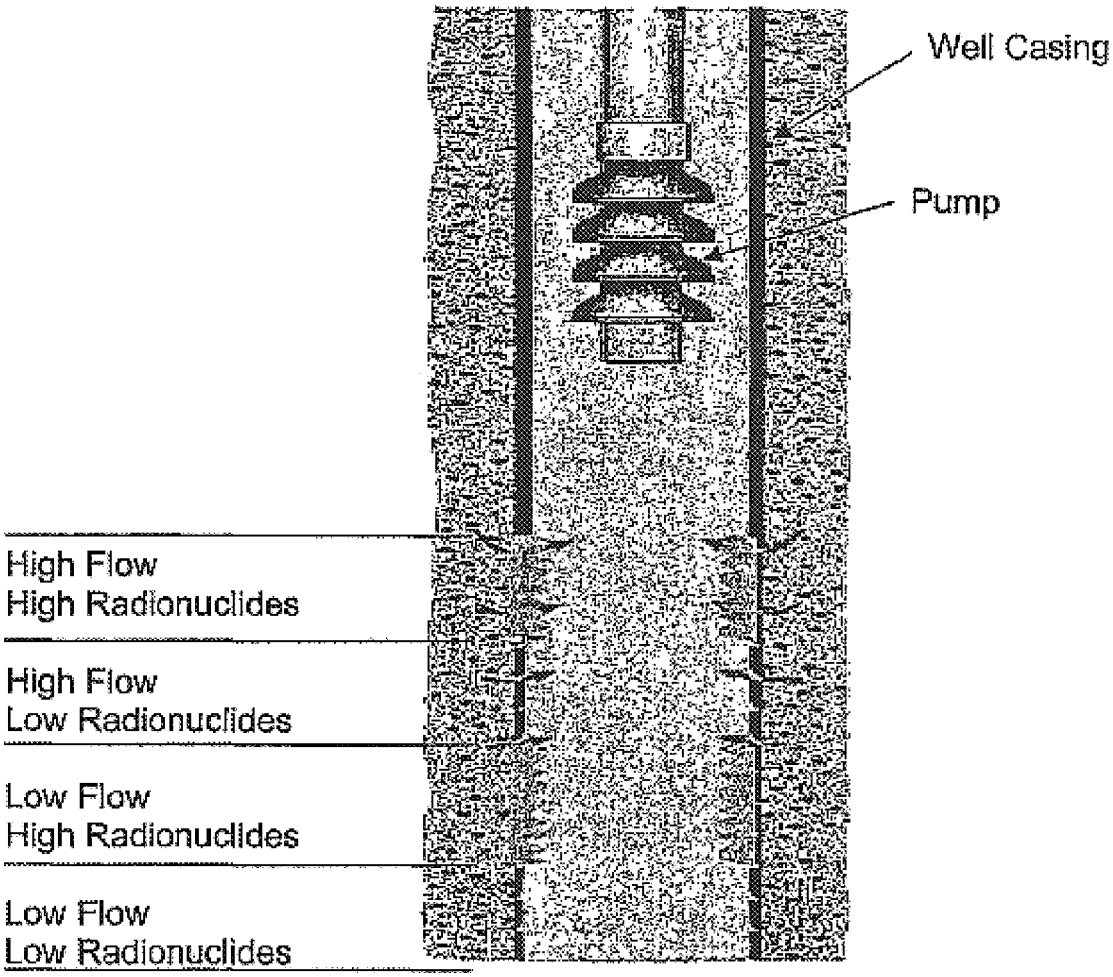
FIG. 2 illustrates the water well of FIG. 1 with the mineral cake removed.
Figure 3:
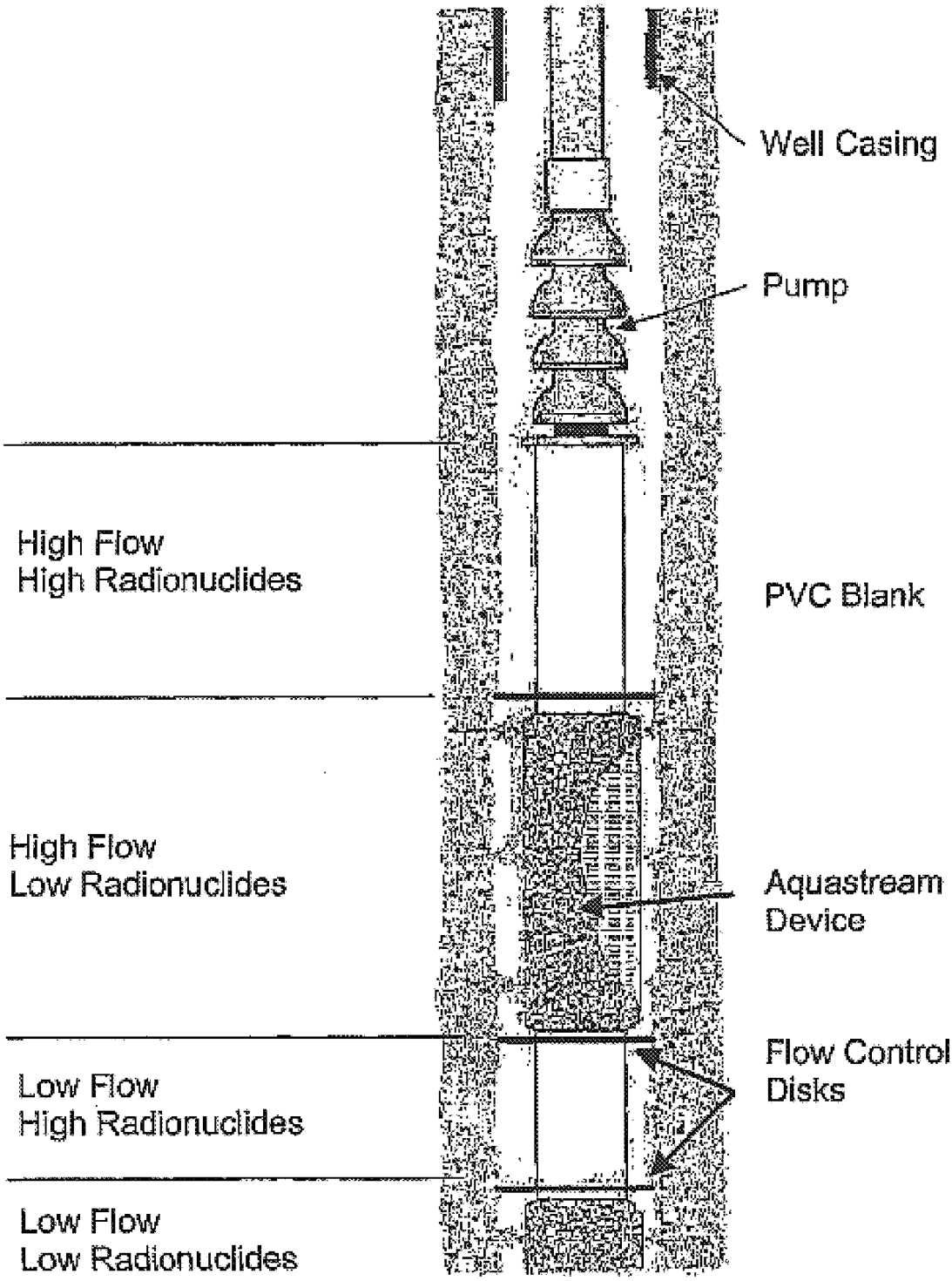
FIG. 3 illustrates the water well of FIG. 1 with suction flow devices and flow control disks installed on the end of the pump.
Figure 4:
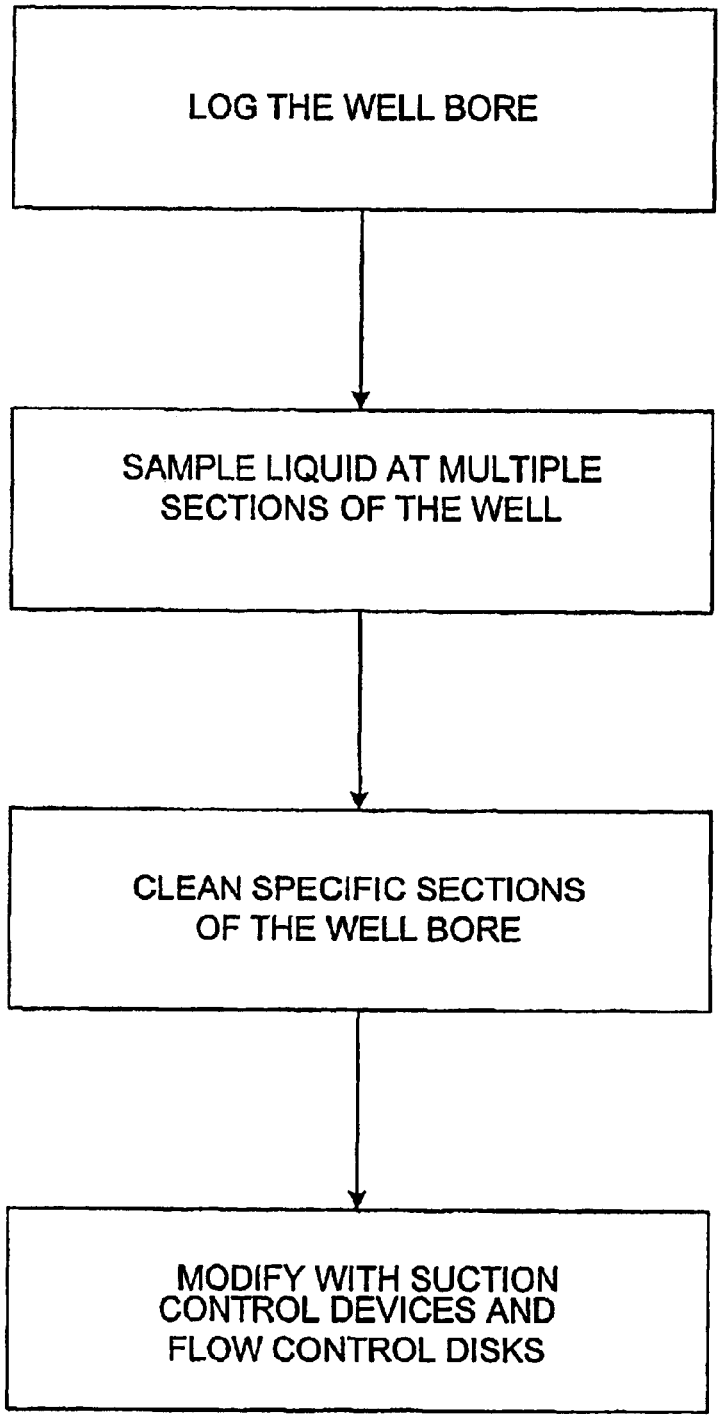
FIG. 4 is a flow chart that represents one embodiment of the process of the present invention.

Once the different strata are logged and sampled, the entire formation can be cleaned to remove the mineral cake within the well (see FIG. 1). Water wells typically develop a mineral cake along the inside surface of the well bore due to the precipitation of minerals. For example, it is well known that calcium carbonate commonly cakes along the inner surface of many wells due to the pressure drop at that location. It is theorized that carbonate cake also contains radioactive minerals and other contaminants and that the levels of radiation in the cake will increase over time. It is believed that the radioactive minerals could solubilize and contaminate water flowing through the mineral cake. In this regard, removal of the mineral cake has been found to decrease the level of radionuclides in the corresponding water.

Removal of the mineral cake can be accomplished by many different techniques, including explosives, chemicals, or any other appropriate technique. In the preferred embodiment, the mineral cake is removed using a high-pressure air gun provided by Bolt Technology Corp. of Norwalk, Conn. under the trademark AIRBURST. A more detailed disclosure of the AIRBURST high-pressure air gun technology is set forth in U.S. Pat. No. 5,579,845, which is incorporated herein by reference in its entirety. The AIRBURST high-pressure air gun technology utilizes pressure waveforms and a mass displacement within a well bore in order to break loose the mineral cake from the well bore. The mineral cake can then be suctioned from the bottom of the well.

In order to further enhance the beneficial characteristics of the process, the cleaning of mineral cake can be performed specifically in those areas that were identified as having low contamination levels in the above-described logging and sampling procedure. More specifically, the AIRBURST high-pressure air gun technique can be performed at selected locations within the well, thereby removing mineral cake from specific locations within the well. Removal of the mineral cake will result in higher flow of water from those sections of the well. In order to further enhance flow, those sections of the well can also be cleaned using a chemical cleaning process. The specific chemicals used in typical cleaning processes are known in the art, and are not the subject of the present patent application.

Upon completion of the cleaning process, additional logging and sampling can be performed in order to confirm that contaminated levels within the well, particularly at the selected sections of the well, are lower than existed prior to treatment.

Phase II of the process includes modification of the pump structure in order to promote flow of water from the areas of the well that have low contamination. More specifically, referring to FIG. 3, a series of suction control devices are used to focus the suction of the pump at specific areas within the well. The suction control devices in the illustrated embodiment are sold by Sand Control Technologies, Inc. of Fort Worth, Tex. under the trademark AQUASTREAM. A more detailed disclosure of the AQUASTREAM suction control device is set forth in U.S. Pat. No. 4,624,319, which is incorporated herein by reference in its entirety. Each AQUASTREAM suction control device is positioned at an area that has been previously identified as having low contamination. The AQUASTREAM suction control devices are separated from each other by a piping in the form of PVC blank. The piping is preferably positioned at areas of the well that have been previously identified as producing water having high contamination. By positioning the AQUASTREAM suction control devices at the selected locations, it can be seen that flow of water from the areas of low contamination will be enhanced, and flow of water from the areas of high contamination will be inhibited.

In order to further decrease the amount of water flowing from the more contaminated sections of the well to the less contaminated sections of the well, the pump equipment can be provided with flow control disks that extend radially from either the AQUASTREAM suction control devices or the piping. The flow control disks extend toward the inner surface of the well bore to provide a barrier within the well. This barrier reduces the amount of mixing of liquid between the various sections within the well, thereby further reducing the amount of contaminated water that is pumped from the well. The shape and size of the disks can be chosen to substantially match the shape of a particular well configuration. In addition, the disks can be made from any appropriate material, such as a polymeric material, PVC, elastomeric material (e.g., wire-reinforced rubber), metal, or any other material that provides desired barrier.

The foregoing description of the present invention has been presented for purposes of illustration and description. Furthermore, the description is not intended to limit the invention to the form disclosed herein. Consequently, variations and modifications commensurate with the above teachings, and the skill or knowledge of the relevant art, are within the scope of the present invention. The embodiments described herein are further intended to explain best modes known for practicing the invention and to enable others skilled in the art to utilize the invention in such, or other, embodiments and with various modifications required by the particular applications or uses of the present invention.

What is claimed is:

1. A method of improving the quality of liquid coming from a water well that has a pump and pipe assembly, the method comprising:

identifying a region of the well that is low in contamination and a region of the well that is high in contamination; and modifying the pump and pipe assembly so that suction of the assembly is enhanced in the region that is low in contamination and inhibited in the region that is high in contamination.

2. The method of claim 1, wherein identifying includes logging the well bore.

3. The method of claim 2, wherein logging includes at least one process selected from the group consisting of caliper logging, spinner logging, and gamma logging.

4. The method of claim 1, wherein identifying includes sampling the liquid in the well in multiple regions.

5. The method of claim 4, wherein sampling includes testing the level of contamination of liquid sampled from multiple regions of the well.

6. The method of claim 1, further comprising cleaning the well in the region of low contamination more than the region of high contamination.

7. The method of claim 6, wherein cleaning includes removing sediment from an inner wall of the well.

8. The method of claim 7, wherein removing includes producing a pressure wave within the well in the region of low contamination.

9. The method of claim 1, wherein modifying the pump and pipe assembly includes:

coupling a suction control device to the pump and pipe assembly; and positioning the suction control device in the region of low contamination.

10. The method of claim 1, wherein identifying includes identifying at least two regions of low contamination, and wherein modifying the pump and pipe assembly includes:

coupling a first suction control device to the pump and pipe assembly;

positioning the first suction control device in one of the regions of low contamination;

coupling a second suction control device to the first suction control device; and positioning the second suction control device in another of the regions of low contamination.

11. The method of claim 1, wherein modifying the pump and pipe assembly includes forming a barrier between the region of low contamination and the region of high contamination.

12. The method of claim 11, wherein forming a barrier includes:

attaching a flow control disk to the pump and pipe assembly; and positioning the flow control disk in a location that is substantially between the region of low contamination and the region of high contamination.

* * * * *